US008270104B2

(12) United States Patent
Windauer

(10) Patent No.: US 8,270,104 B2
(45) Date of Patent: Sep. 18, 2012

(54) OPERATOR-SELECTABLE-STOP TURRET KNOB

(76) Inventor: Bernard T. Windauer, Kalispell, MT (US)

( * ) Notice: Subject to any disclaimer, the term of this patent is extended or adjusted under 35 U.S.C. 154(b) by 98 days.

(21) Appl. No.: 13/000,712

(22) PCT Filed: Jun. 22, 2009

(86) PCT No.: PCT/US2009/048183

§ 371 (c)(1),
(2), (4) Date: Dec. 22, 2010

(87) PCT Pub. No.: WO2010/008810

PCT Pub. Date: Jan. 21, 2010

(65) Prior Publication Data

US 2011/0102918 A1 May 5, 2011

Related U.S. Application Data

(60) Provisional application No. 61/074,646, filed on Jun. 22, 2008.

(51) Int. Cl.
*G02B 7/02* (2006.01)
*G02B 21/00* (2006.01)
*B23B 29/24* (2006.01)

(52) U.S. Cl. ..... 359/821; 359/381; 359/384; 74/813 L; 74/813 R; 42/122

(58) Field of Classification Search ..... 359/821, 359/368, 381, 384, 405; 74/813 L; 42/133, 42/136, 137; 409/182; 43/21.2; 242/245, 242/291, 303

See application file for complete search history.

(56) References Cited

U.S. PATENT DOCUMENTS

| | | | |
|---|---|---|---|
| 1,107,163 | A | 8/1914 | Grauheding |
| 1,127,230 | A | 2/1915 | Grauheding |
| 1,344,974 | A | 6/1920 | Bader |
| 2,143,167 | A | 1/1939 | Pechar |
| 2,165,796 | A | 7/1939 | Humeston |
| 2,208,913 | A | 7/1940 | Unertl |

(Continued)

FOREIGN PATENT DOCUMENTS

CN 2752794 1/2006

(Continued)

OTHER PUBLICATIONS

PCT/US2009/048183, International Search Report, Feb. 11, 2010, 3 pages.

(Continued)

*Primary Examiner* — Loha Ben
(74) *Attorney, Agent, or Firm* — Joseph P. Curtin, L.L.C.

(57) ABSTRACT

A turret knob comprises an adjustable member, an engagement member and a plurality of stop members. The adjustable member is capable of being adjustably positionable about an axis of rotation. The engagement member is coupled to the adjustment member, and a relative position of the engagement member with respect to the axis of rotation corresponds to a position of the adjustable member as the adjustable member is adjustably positioned about the axis of rotation. The plurality of stop members are each selectably positioned about the axis of rotation. Each stop member is capable of interfering with the engagement member and blocking movement of the adjustable member as the adjustable member is adjustably positioned about the axis of rotation. The adjustable member is adjustably positionable about the axis of rotation between adjacent stop member positions.

13 Claims, 7 Drawing Sheets

U.S. PATENT DOCUMENTS 2,229,637 A 1/1941 Burton
2,336,107 A 12/1943 Litschert
2,452,592 A 11/1948 Meyer
2,583,042 A 1/1952 Dayton
2,585,933 A 2/1952 Harvey
2,682,707 A 7/1954 Dahlberg
2,913,826 A 11/1959 Petty
3,037,287 A 6/1962 Glatz et al.
3,058,391 A 10/1962 Leupold
3,222,987 A 12/1965 Wrigglesworth
3,280,463 A 10/1966 Stadler
3,297,389 A 1/1967 Gibson
3,471,932 A 10/1969 Luning
3,662,618 A 5/1972 Kroll et al.
3,707,204 A 12/1972 Dussardier
3,826,012 A * 7/1974 Pachmayr ..... 42/122
3,916,721 A 11/1975 Egger
3,948,587 A 4/1976 Rubbert
3,962,795 A 6/1976 Ross
3,986,409 A 10/1976 Tripp et al.
3,990,155 A 11/1976 Akin, Jr. et al.
3,994,608 A 11/1976 Swiderski et al.
3,999,442 A 12/1976 Decker et al.
4,000,539 A 1/1977 Neyer
4,007,956 A 2/1977 Harris et al.
4,012,966 A 3/1977 Lieberman et al.
4,026,397 A 5/1977 Raus
4,037,490 A 7/1977 Wilson
4,038,757 A 8/1977 Hicks et al.
4,050,265 A 9/1977 Drennen et al.
4,066,849 A 1/1978 Chladil, Sr.
4,084,675 A 4/1978 Smith et al.
4,094,210 A 6/1978 Wirtz et al.
4,113,399 A 9/1978 Hansen, Sr.
4,131,033 A 12/1978 Wright et al.
4,132,129 A 1/1979 Pratt
4,136,569 A 1/1979 Hollweck
4,147,445 A 4/1979 Claesson
4,154,125 A 5/1979 Frank
4,197,765 A 4/1980 Shimoda
4,200,355 A 4/1980 Williams, Jr.
4,201,096 A 5/1980 Morrison et al.
4,247,161 A 1/1981 Unertl, Jr.
4,269,119 A 5/1981 Strausburg
4,295,246 A 10/1981 Howie, Jr.
4,300,525 A 11/1981 Delgado et al.
4,347,758 A 9/1982 Geil et al.
4,373,269 A 2/1983 Doliber et al.
4,373,405 A 2/1983 Geil
4,389,791 A 6/1983 Ackerman
4,408,842 A 10/1983 Gibson
4,433,218 A 2/1984 Provencher
4,457,076 A 7/1984 Heck
4,461,330 A 7/1984 Judkins
4,499,630 A 2/1985 Harris et al.
4,532,826 A 8/1985 White
4,616,524 A 10/1986 Bidoia
4,618,221 A * 10/1986 Thomas ..... 359/428
4,643,542 A 2/1987 Gibson
4,779,305 A 10/1988 Gorsek
4,836,708 A 6/1989 Chambers et al.
4,955,253 A 9/1990 Sakai et al.
4,982,502 A 1/1991 Weyrauch
5,020,389 A 6/1991 Sigler
5,037,066 A 8/1991 Kerger et al.
5,039,830 A 8/1991 Orillard
5,048,365 A 9/1991 Webb
5,083,477 A 1/1992 Geil
5,109,727 A 5/1992 Joyce
5,121,653 A 6/1992 Sigler
5,129,283 A 7/1992 Koehler
5,152,187 A 10/1992 LaFemina
5,276,554 A 1/1994 Nassivera
5,329,829 A 7/1994 Sell
5,345,838 A 9/1994 Howie, Jr.
5,363,559 A 11/1994 McCarty
5,363,720 A 11/1994 Sanchez
5,388,005 A 2/1995 Wilson
5,433,010 A 7/1995 Bell
5,450,653 A 9/1995 Howie, Jr.
5,499,456 A 3/1996 Tomita
5,513,440 A 5/1996 Murg
5,586,569 A 12/1996 Hanning et al.
5,603,393 A 2/1997 Ghode et al.
5,613,275 A 3/1997 Kolberg et al.
5,615,487 A 4/1997 Tomita
5,618,374 A 4/1997 Byerley
5,671,904 A 9/1997 Minutillo
5,694,815 A 12/1997 Biber et al.
5,695,125 A 12/1997 Kumar
5,715,607 A 2/1998 Murg
5,741,003 A 4/1998 Segien, Jr.
5,745,287 A 4/1998 Sauter
5,765,449 A 6/1998 LeMire
5,771,595 A 6/1998 Bell
5,806,378 A 9/1998 Friedman
5,862,715 A 1/1999 Lemire
5,892,617 A 4/1999 Wallace
5,906,141 A 5/1999 Abdelmoula
5,930,934 A 8/1999 Fisher et al.
5,947,671 A 9/1999 Kanaan et al.
5,983,748 A 11/1999 Ueno
6,005,711 A 12/1999 Mai et al.
6,237,440 B1 5/2001 Lebelo
6,279,259 B1 8/2001 Otteman
6,351,907 B1 3/2002 Otteman
6,442,854 B1 9/2002 Liu et al.
6,508,144 B1 1/2003 Vendetti et al.
6,519,890 B1 2/2003 Otteman
D476,714 S 7/2003 Meinzer
6,588,125 B2 7/2003 Proctor, Sr.
6,640,481 B1 11/2003 Williams, Jr.
6,643,970 B2 11/2003 Huber
6,705,037 B2 3/2004 Van Kirk
6,772,550 B1 8/2004 Leatherwood
6,848,628 B2 2/2005 Walker
6,860,442 B2 3/2005 Datcuk, Jr.
6,862,832 B2 3/2005 Barrett
7,117,624 B2 10/2006 Kim
7,121,037 B2 10/2006 Penny
7,145,107 B2 12/2006 Nguyen et al.
7,151,240 B2 12/2006 Joubran et al.
7,259,908 B2 8/2007 Wagener
7,330,310 B2 2/2008 Hengst et al.
7,415,791 B2 8/2008 Williams, III et al.
7,578,091 B2 8/2009 Klepp et al.
7,581,346 B2 9/2009 Klepp et al.
7,612,952 B2 11/2009 Schafer
7,626,760 B2 12/2009 Wu
7,640,830 B2 * 1/2010 Bonis ..... 74/813 L
7,654,483 B1 * 2/2010 Martin et al. ..... 242/303
7,676,137 B2 3/2010 Schick et al.
7,706,065 B2 4/2010 Regan et al.
7,836,626 B2 11/2010 Shepherd
2001/0025545 A1 10/2001 Rogers
2004/0088898 A1 5/2004 Barrett
2006/0107580 A1 5/2006 Thomas et al.
2006/0254115 A1 11/2006 Thomas et al.
2006/0268433 A1 11/2006 Thomas
2006/0278035 A1 12/2006 Casas
2007/0240356 A1 10/2007 Klepp et al.
2008/0066364 A1 3/2008 Klepp et al.
2008/0236018 A1 10/2008 Halverson
2009/0064561 A1 3/2009 Piltonen
2009/0205461 A1 8/2009 Windauer

FOREIGN PATENT DOCUMENTS

DE 2148967 4/1973
DE 297 20 737 U1 3/1998
DE 299 03 989 U1 6/1999
DE 203 01 749 U1 4/2003
DE 102 22 528 A1 12/2003
DE 202006003770 U 6/2006
GB 598306 2/1948
GB 708438 5/1954
GB 1102022 2/1968
GB 1214584 12/1970

| | | | |
|---|---|---|---|
| GB | 2 213 959 | A | 8/1989 |
| JP | 11-085290 | | 3/1999 |
| JP | 2000-297806 | | 10/2000 |
| WO | 2006/060490 | A2 | 6/2006 |
| WO | 2006/109587 | A1 | 10/2006 |

OTHER PUBLICATIONS

PCT/US2009/048183, Written Opinion, Feb. 11, 2010, 6 pages.

* cited by examiner

VIEW A-A

VIEW B-B

OPERATOR-SELECTABLE-STOP TURRET KNOB

CROSS-REFERENCE TO RELATED PATENT APPLICATIONS

The present Patent Application claims priority to U.S. Provisional Patent Application Ser. No. 61/074,646, filed Jun. 22, 2008, entitled "Operator Selectable Stop (OSS) Turret Knob," and PCT Patent Application PCT/US2008/048183, filed Jun. 22, 2009, entitled "Operator-Selectable-Stop Turret Knob," both having been invented by Bernard T. Windauer, and the disclosures of both being incorporated by reference herein.

BACKGROUND

The subject matter disclosed herein relates to an optical enhancing device, such as a telescopic observation sighting device or individual shoulder (or hand-fired) firearms sighting device (telescopic sight herein). Embodiments according to the subject matter disclosed herein may also be used with any optical enhancing device containing adjusters, such as a microscope, telescope, etc. For purposes of illustration, it will be assumed herein that the optical enhancing device is a telescopic firearms sight.

A telescopic sight, typically used to aim a firearm, is usually mounted on the firearm. An adjustment knob on a telescopic sight is typically used for changing a setting of an adjuster, for example, elevation, crossrange (also "windage" herein), or parallax, of the telescopic sight. Parameters such as elevation, crossrange, and parallax, may be painstakingly set in order that the projectile fired from the firearm hit a specific target. Once set for a particular target parameter, the setting preferably remains unchanged until after a shot is fired at the target.

Existing telescopic sighting systems for civilian, law enforcement, and military firearms typically utilize two types of adjustment knobs. The first type of adjustment knob is allowed to rotate freely. The knob is permanently exposed, or is uncovered by removing a cover cap to make an adjustment. The second type of knob is a locking knob in which the lock must be released prior to making an adjustment. Around the circumference of both types of knobs are numerals and index marks to indicate the rotational setting of the knob with respect to a fixed datum mark. To adjust the knob of the telescopic sight so that the projectile impacts the target at a known distance requires an operator to visually check the reference marks against the datum mark to verify the settings are correct. In some circumstances, such as a military or tactical application in which the telescopic sight is used in the dark, the operator cannot visually check the telescopic sight setting.

BRIEF DESCRIPTION OF THE DRAWINGS

The subject matter disclosed herein is illustrated by way of example and not by limitation in the accompanying figures in which like reference numerals indicate similar elements and in which.

DETAILED DESCRIPTION

The word "exemplary" is used herein to mean "serving as an example, instance, or illustration." Any embodiment described herein as "exemplary" is not to be construed as necessarily preferred or advantageous over other embodiments.

The subject matter disclosed herein provides an adjustment knob that has a mechanically or tactile indication of the desired sight setting. Additionally, the subject matter disclosed herein provides in one exemplary embodiment a knob having a settable mechanical/tactile setting that is selectably set by an operator for special-sighting applications. In another exemplary embodiment a knob having a pre-set mechanical/tactile setting for specific standard ammunition types.

The subject matter disclosed herein also provides an adjustment knob that has either a single or multiple mechanical stops that can be set by an operator when a specific single or multiple sight settings are desired for specific factory or custom loaded ammunition types. The subject matter disclosed herein additionally provides an adjustment knob that has either a single or multiple mechanical stops that can be pre-set by an armorer for a specific ammunition type.

The subject matter disclosed herein provides an adjustment knob for an optical setting, such as elevation, windage, parallax, or illuminated reticle power control for an optical-based instrument, such as a telescopic sighting system, a telescope or a microscope, that can be mechanically stopped at a single location or at multiple locations, thereby eliminating the need to view the numerical or linear index marks to indicate sight settings. Accordingly, one exemplary embodiment of the subject matter disclosed herein allows a user to mechanically set the stops of the adjustment knob, thereby permitting a desired adjustment of an optical or power setting without needing to visually observe the value of the adjustment during use. Thus, optical or power settings set by a user are reliably repeatedly made during use without the need for visual verification regardless of the environmental conditions.

In one exemplary embodiment, the subject matter disclosed herein allows an operator (or shooter) the ability to adjust a turret knob to stop, or be "confined," at a numerical (rotational) setting that corresponds to a desired projectile Point Of Impact (POI) at a desired range. The subject matter disclosed herein allows the operator to set a bottom stop position and multiple stops every ½ mil (or minute-of-arc) rotational position. Additionally, one exemplary alternative embodiment of the subject matter disclosed herein allows an operator (or shooter) the ability to adjust the turret knob to stop at a numerical (rotational) setting that corresponds to a desired projectile point of impact (POI) at a desired range. The design allows the operator to have a "zero" location for the bottom end of the scope adjustments and multiple stops at rotational settings chosen by the operator.

Figure 1B:
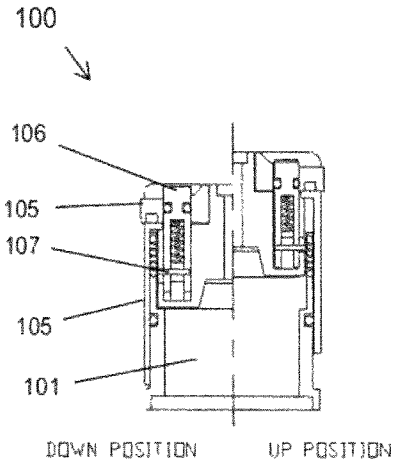
FIG. 1B depicts the down position and the up positions of the exemplary embodiment of an OSSTK according to the subject matter disclosed herein.
Figure 1A:
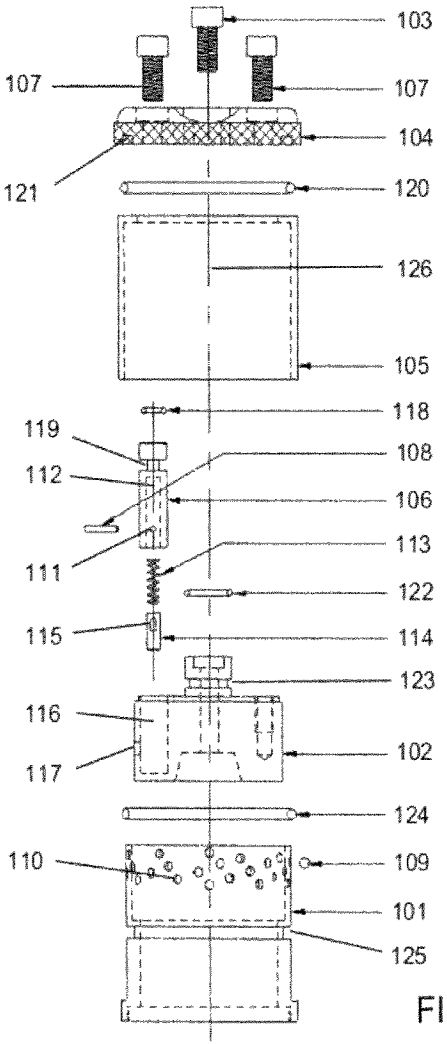
FIG. 1A depicts an exploded assembly cross-sectional view of an exemplary embodiment of an Operator Selectable Stop Turret Knob (OSSTK) according to the subject matter disclosed herein.

FIG. 1A depicts an exploded assembly cross-sectional view of a first exemplary embodiment of an Operator Selectable Stop Turret Knob (OSSTK) 100 according to the subject matter disclosed herein. As shown in FIG. 1A, OSSTK 100 comprises a stop-knob sleeve 101, a stem hub 102, a hub cap-screw 103, a turret-knob cap 104, an index skirt 105, and a release button 106.

Stop-knob sleeve 101 is affixed in a fixed position in a well-known manner to a scope body (not shown). Stem hub 102 is held to the rotating (movable) stem of the scope (not shown) via hub cap-screw 103 and is adjustably positionable in a well-known manner about an axis of rotation 126. When the bottom position and desired stop points are determined through shooting, two turret knob cap cap-screws 107 are removed and turret-knob cap 104 and index skirt 105 are removed. Hub cap-screw 103 is loosened and stem hub 102 is rotated so that a stop pin 108 that is inserted through a hole 111 in release button 106 is pointing to the rear of the scope body so that it is in line with a fixed datum mark (not shown) on stop-knob sleeve 101. Hub cap-screw 103 is then tightened to secure stem hub 102 to the scope rotating stem (not shown).

Release button 106 comprises an aperture 111 that passes radially through the longitudinal axis of release button 106, and a blind aperture 112 that extends along the longitudinal axis. A spring 113 fits inside blind aperture 112 and is held in place by a button-release plunger 114 that comprises an aperture 115 that corresponds to aperture 111 in release button 106 so that spring 113 and plunger 114 are held captive inside blind aperture 112 when stop pin 108 is inserted through apertures 111 and 115. When assembled, release button 106 fits inside blind aperture 116 of stem hub 102 so that stop pin 108 protrudes through aperture 117 of stem hub 102. An O-ring 118 fits into annular slot 119 to form a seal for release button 106 at turret-knob cap 104 when OSSTK 100 is fully assembled.

Returning to the setting procedure, ball bearings 109 (of which only one ball bearing 109 is indicated) are then inserted into selected holes 110 of stop-knob sleeve 101 to provide stop locations for desired settings. It should be understood that in an exemplary alternative embodiment, stop members, such as a stop pins, could be substituted for ball bearings 109. In yet another exemplary alternative embodiment, the stop members could be a combination of ball bearings 109 and stop pins. When a rotational setting is determined through shooting or predetermined through calculation, the assembly is rotated to that position. The knob cap 104 and index skirt 105 are removed and the relative position of stop pin 108 is compared to a hole 110 in stop-knob sleeve. Into this hole is placed a ball bearing 109 to create a stop position. This procedure is repeated for the desired number of stop positions. Index skirt 105 is then slipped over stop-knob sleeve 101 to retain ball bearings 109 in the selected holes 110.

Turret-knob cap 104 is then secured via cap screws 107, thereby clamping index skirt 105 to stem hub 102 so that the numerical "zero" index mark (not shown) etched on the outside circumference of index skirt 105 aligns with the fixed datum mark (not shown) on stop-knob sleeve 101. O-ring seal 120 fits into annular slot 121 in turret-knob cap 104, thereby sealing the mechanical fit of turret-knob cap 104 onto index skirt 105 when OSSTK 100 is fully assembled. Similarly, o-ring seal 122 fits into annular slot 123 in stem hub 102, and o-ring seal 124 fits into annular slot 125 when OSSTK 100 is fully assembled.

OSSTK 100 is operated by rotating index skirt 106 and turret-knob cap 104 until stop pin 108 interferes with (bumps into) the ball bearing 109 located at the first stop position. At this setting, the scope allows the operator to fire the firearm and have the projectile impact the target at the desired position at the first target range. To continue on to the next stop setting, release button 106 is depressed by the operator (accessible on the top of the turret-knob cap 104) so that stop pin 108 drops below the ball bearing 109, thereby allowing stem hub 102, index skirt 105, and turret-knob cap 104 to continue to rotate to the next setting.

FIG. 1B depicts the fully down position and the fully up positions of OSSTK 100 as OSSTK 100 is rotated from one extreme to the other. The left portion of OSSTK 100 shown in FIG. 1B is depicted in the fully down position, while the right portion of OSSTK 100 is depicted in the fully up position. As OSSTK 100 is rotated in the direction from the fully down position towards the fully up position or in the direction of the fully up position to the fully down position, each operator-selectable stop provides a stop position that can be overridden by pressing release button 106. Between operator-selectable stops, OSSTK 100 can be rotated for fine adjustments. To move beyond an operator-selectable stop, the release button must be pressed.

A second exemplary embodiment of the subject matter disclosed herein provides the ability to "confine" the rotating assembly into a desired stop position with the ability to rotate a predetermined number of "clicks" on either side of the stop position. In particular, the second exemplary embodiment allows intermediate adjustments between stops.

Figure 2A:
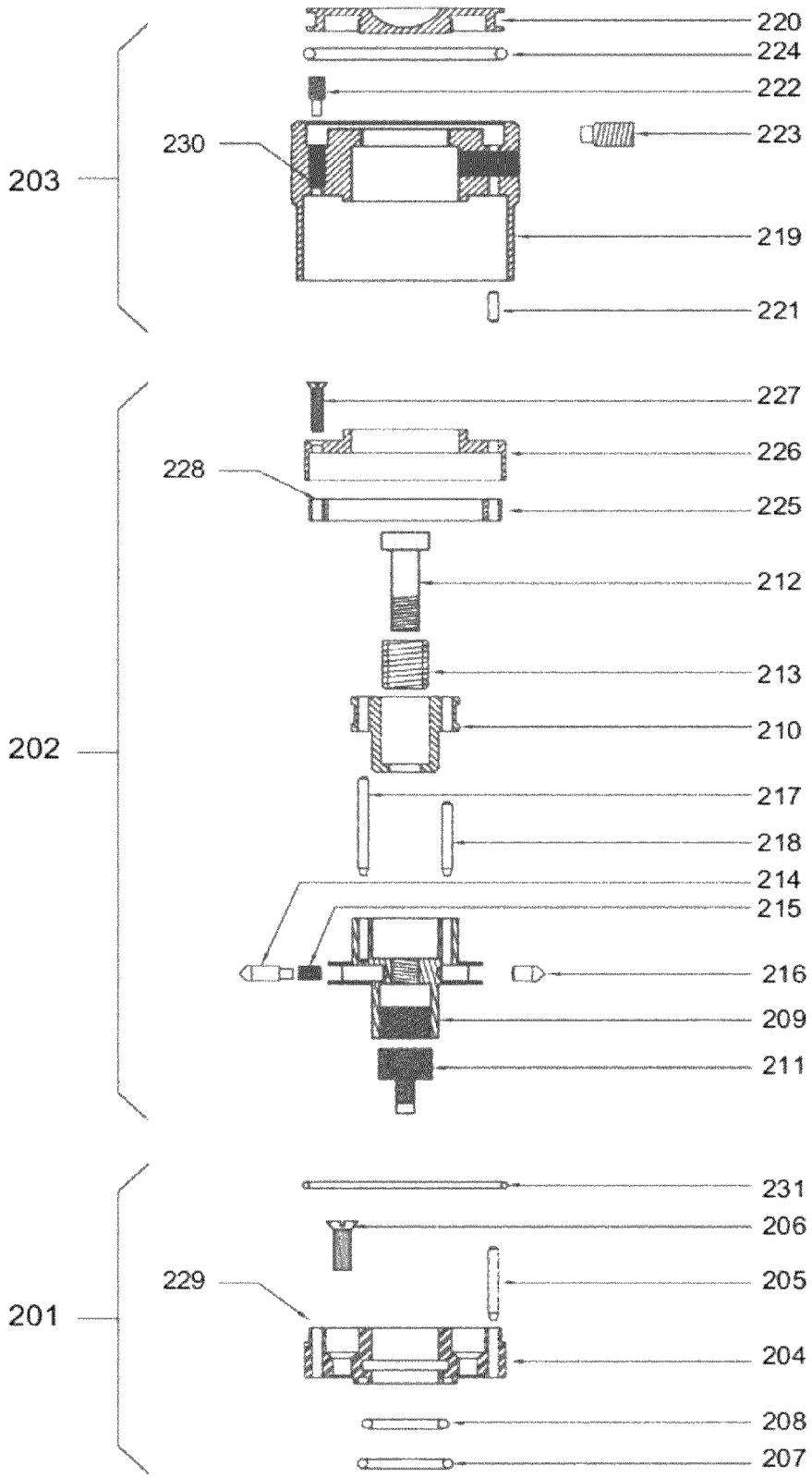
FIG. 2A depicts an exploded assembly cross-sectional view of an exemplary embodiment of a Set-Screw OSSTK (SSOSSTK) according to the subject matter disclosed herein.
Figure 2B:
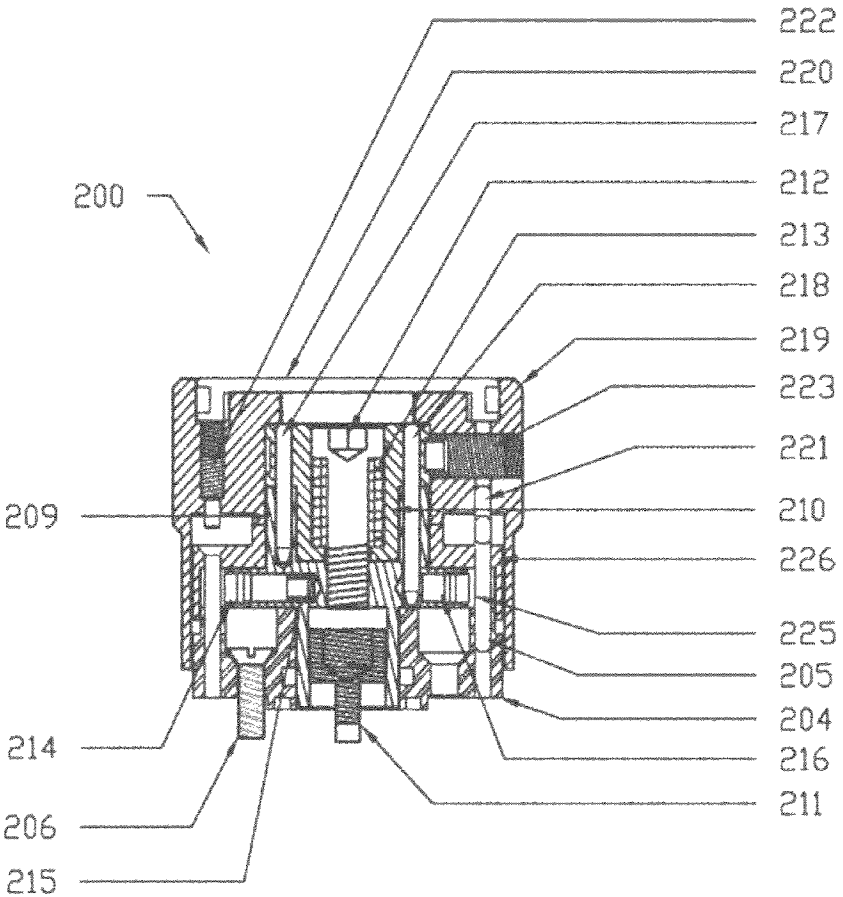
FIG. 2B depicts an assembled cross-sectional view of the exemplary embodiment of the SSOSSTK according to the subject matter disclosed herein.

FIG. 2A depicts an exploded assembly cross-sectional view of an exemplary embodiment of a Set Screw OSSTK (SSOSSTK) 200 according to the subject matter disclosed herein. FIG. 2B depicts an assembled cross-sectional view of the exemplary embodiment of Set Screw SSOSSTK 200 according to the subject matter disclosed herein.

As shown in FIG. 2A, SSOSSTK 200 comprises a turret base assembly 201, a hub assembly 202 and a knob assembly 203. Turret base assembly 201 comprises a turret base 204, a base zero pin 205, and a plurality of knob base screws 206, of which only one knob base screw is shown. Turret base assembly 201 is affixed in a well-known manner to a scope body (not shown) in a fixed position, such as by knob base screws 206. An O-ring 207 is used to form a seal between the bottom of turret base assembly 201 and the scope body. An O-ring 208 is used to form a seal between turret base assembly 201 and hub assembly 202 when hub assembly 202 is inserted into turret base assembly 201.

Hub assembly 202 comprises a turret adjustment hub 209, a hub adjustment cap 210, a spade screw 211, a cap-screw 212 and a hub cap-screw spring 213. Hub assembly 202 also comprises a primary ratchet pin 214 and corresponding spring 215, a secondary ratchet pin 216, a hub adjustment cap dowel pin 217 and a hub adjustment cap guide pin 218. Hub assembly 202 is adjustably positionable in a well-known manner about an axis of rotation (not shown) in order to make adjustments to the scope (not shown).

Knob assembly 203 comprises a turret knob 219, a knob cover cap 220, a knob zero pin 221, a plurality of knob stop-screws 222, of which only one knob stop-screw is shown, and a plurality of knob set-screws 223, of which only one knob set-screw is shown. An O-ring 224 is used as a seal when knob cover cap 220 is mounted to turret knob 219 to prevent knob stop screws 222 from becoming environmentally contaminated.

Hub assembly 202 is inserted into turret base assembly 201. An internal ring gear 225 is placed over the hub assembly 202 and on top of the turret base assembly 201 and located in position by the zero pin 205 and screws 227. Internal ring gear 225 encircles the hub assembly 202. Internal ring gear 225 comprises a plurality of gear teeth that are arranged around the 360° inside circumference of the ring gear. The spacing or the number of gear teeth determine how many degrees of rotation there are for each tactile "click." The pitch (the number of threads per inc) of the threads on spade screw 211 and the degrees of rotation of hub 209 determine the movement (either extension or retraction of spade screw 211 from hub 209) in an axial direction to move the reticle (crosshairs) lens assembly with the scope. The spade of spade screw 211 protrudes through a slot in the scope body, therefore it does not rotate with adjustment hub 20, but can only move vertically based on the rotation of hub 209. Internal ring gear retainer 226 is then installed and held in place with four retainer screws 227, of which only one retainer screw 227 is shown, that pass through apertures 228 in the internal ring gear 225 and engage apertures 229 in turret base 204. Hub adjustment cap 210 is then inserted into turret adjustment hub 209 and held in place by hub cap-screw spring 212 and cap-screw 213. Knob assembly 203 is then installed and held in place with two knob set screws 223, of which only one knob set screw 223 is shown. O-ring 231 provides a seal between knob assembly 203 and turret base 204.

To zero the exemplary embodiment of the SSOSSTK 200, the firearm is shot at the desired closest distance to the target. Knob set screws 223 are loosened and knob assembly 203 is rotated so that the base zero pin 205 and knob zero pin 221 "bump" one another at which point the "zero" numeral (not shown) etched on the outer circumference of knob assembly 203 aligns with the datum mark (not shown) of turret base assembly 201. Knob set-screws 223 are then tightened. Knob assembly 203 can then be returned to this "zero" setting at any time to assure the projectile impacts at the same desired point of impact at the same "zeroed" distance. In some situations, approximately two "tactile" clicks are desired below the "zero" setting for an occasional shot to be taken closer than the "zero" setting or for fine "zero" sight settings due to changed ambient climatic conditions. If the two (or greater) "tactile" clicks are desired the orientation of zero pin 205 relative to the "zero" numeral on turret knob 219 can be changed.

The exemplary embodiment of the SSOSSTK 200 allows an operator to have a "zero" location for the bottom end of the scope adjustments and multiple stops every ½ mil (or minute-of-arc) rotational position.

To set the "number one" (or first) stop position, the knob cover cap 220 is removed and the firearm is shot at the distance desired for the first stop location. The knob assembly 203 is rotated counter-clockwise (or clockwise if the system is designed for the opposite direction) so that the "crosshair" reticle coincides with the desired projectile point of impact location at the distance for the first stop location. The knob stop screw 222 that is located directly above the datum mark (not shown) of turret base assembly 201 is screwed down (clockwise) until it stops in its hole 230, and thereby creating an interference between knob stop screw 222 and base zero pin 205. Knob assembly 203 can then be returned to this "stop" setting at any time to assure the projectile impacts at the same desired point at the same "stop" distance.

To set the next desired stop position, the knob assembly 203 is lifted to eliminate the interference between the knob stop screw 222 and base zero pin 205 and rotated to the next desired projectile point of impact stop location at the next farthest distance. The knob stop screw 222 that is located directly above the datum mark (not shown) of turret base assembly 201 is screwed down (clockwise) until it stops in its hole. Knob assembly 203 can then be returned to this "stop" setting at any time to assure the bullet impacts at the same desired point at the same "second stop" distance.

The above-described stop-setting procedure is used to set stops at any desired distance.

To return to the "zero" setting, an operator only needs to lift knob assembly 203 to eliminate the interference of the knob stop screws 222 and the base zero pin 205, and turn knob assembly 203 fully clockwise until the "zero" numeral (not shown) etched on the outer circumference of knob assembly 203 aligns with the datum mark of turret base assembly 201. Returning to "zero" can also be "felt" when the knob no longer rotates clockwise (or counter-clockwise) when the knob assembly 203 is lifted to eliminate the interference of the knob stop screw 222 and base zero pin 205. To return to a previously selected stop setting from the "zero" position, the operator only needs to lift knob assembly 203 to eliminate the interference of the knob stop screw 222 and base zero pin 205, and rotate knob assembly 203 clockwise slightly. Knob assembly 203 can be released and allowed to retract, and the operator can continue to rotate knob assembly 203 clockwise until the next selected stop position is encountered, in which a knob stop screw 222 "bumps" into base zero pin 205. If a lower stop location is desired, the operator need only repeat the stop-setting procedure until the desired stop location is achieved. This procedure is used when the knob setting numbers (etched on the outer surface of the knob assembly 203) cannot be visually observed.

Another technique of returning to a different stop location is to lift knob assembly 203 to eliminate the interference of knob stop pins 222 and base zero pin 205, and turn knob assembly 203 clockwise (or counter clockwise) until the corresponding "stop location" number (or intermediate number) etched on the outer circumference of knob assembly 203 aligns with the datum mark (not shown) of turret base assembly 201.

As SSOSSTK 200 is rotated in the direction from the fully clockwise position towards the fully counter-clockwise position or in the direction of the fully clock-wise position to the fully counter-clockwise position, each operator-selectable stop provides a stop position that can be overridden by lifting turret knob 219. Between operator-selectable stops, SSOSSTK 200 can be rotated for fine adjustments. To move beyond an operator-selectable stop, turret knob 219 must be lifted. It should be understood that the exemplary embodiment of the SSOSSTK 200 can be used as a normal turret knob by not engaging (lowering) knob stop screws 222 so that they interfere with base zero pin 205.

Figure 3A:
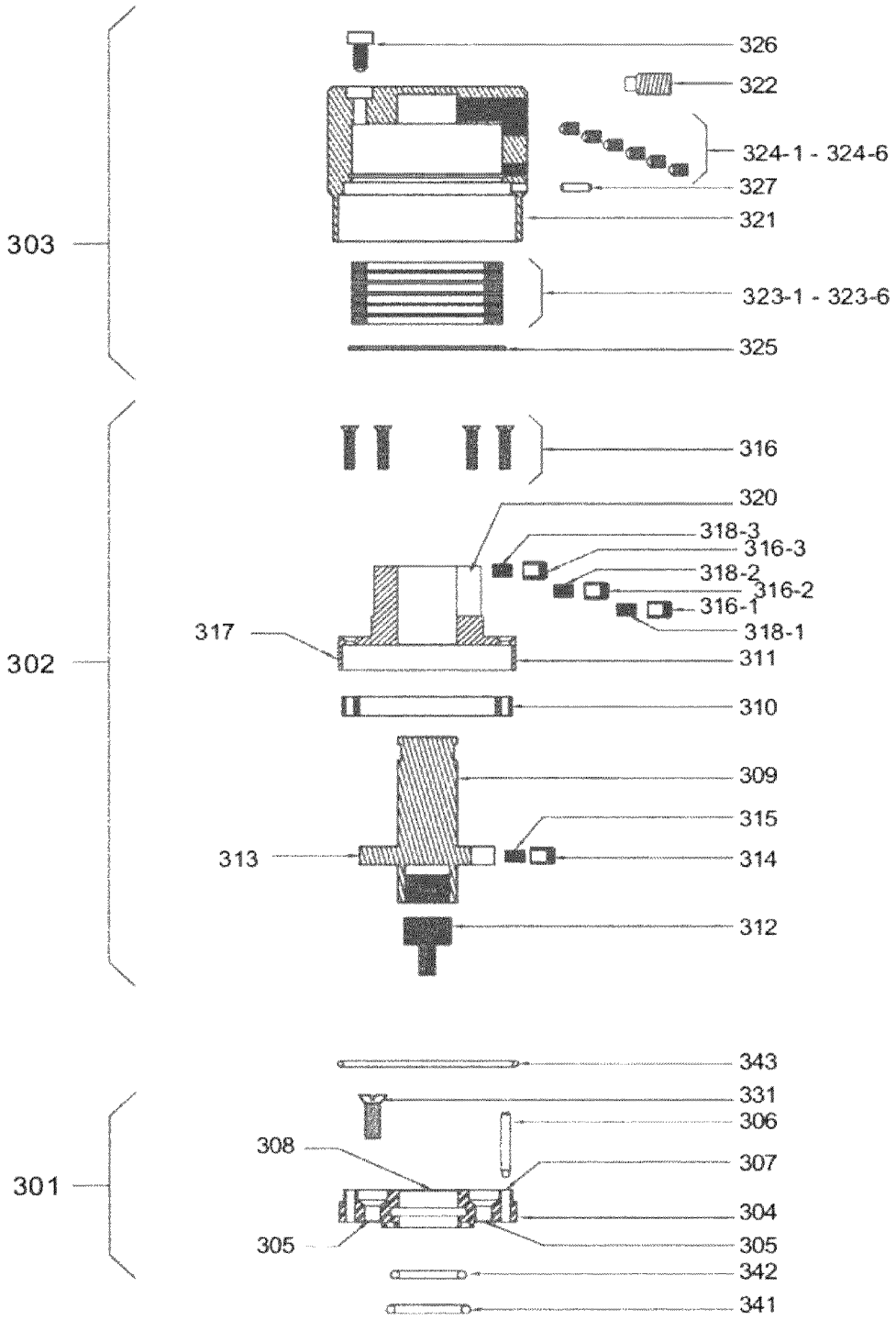
FIG. 3A depicts an exploded assembly cross-sectional view of an exemplary embodiment of a Spring Bar/Stop Ring OSSTK (SBSROSSTK) according to the subject matter disclosed herein.
Figure 3D:
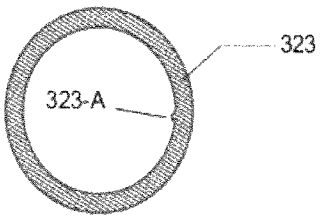
FIG. 3D shows a top view of an exemplary embodiment of a stop ring for the exemplary embodiment of the SBSROSSTK according to the subject matter disclosed herein.
Figure 3C:
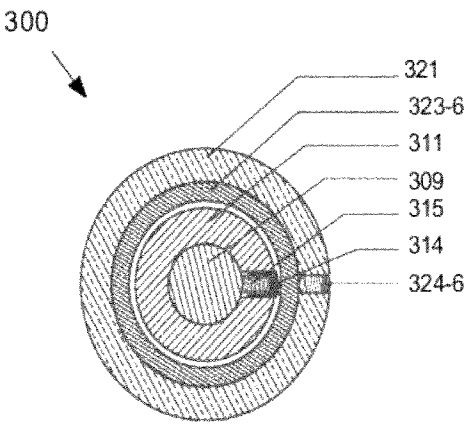
FIG. 3C depicts a top cross-sectional view of the exemplary embodiment of the SBSROSSTK at a first stop configuration taken at View A-A in FIG. 3B according to the subject matter disclosed herein.
Figure 3B:
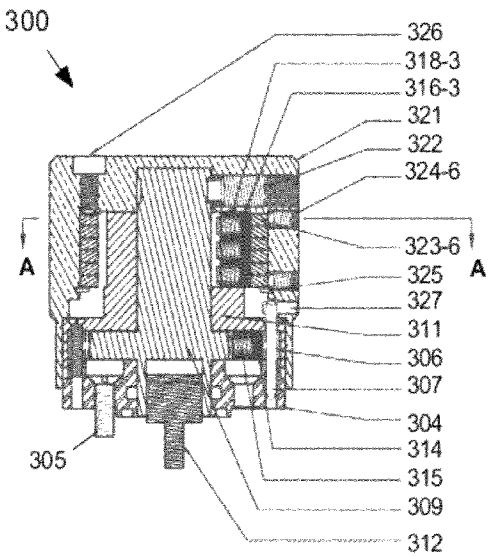
FIG. 3B depicts an assembled cross-sectional view of the exemplary embodiment of the SBSROSSTK in a "zeroed" configuration according to the subject matter disclosed herein.

FIG. 3A depicts an exploded assembly cross-sectional view of an exemplary embodiment of a Spring-Bar/Stop Ring Operator-Selectable-Stop Turret Knob (SBSROSSTK) 300 according to the subject matter disclosed herein. FIG. 3B depicts an assembled cross-sectional view of the exemplary embodiment of SBSROSSTK 300 in a "zeroed" configuration according to the subject matter disclosed herein. FIG. 3C depicts a top cross sectional view of the exemplary embodiment of SBSROSSTK 300 at a first stop configuration taken at View A-A in FIG. 3B according to the subject matter disclosed herein. FIG. 3D shows a top view of an exemplary embodiment of a stop ring 323 for the exemplary embodiment of SBSROSSTK 300 according to the subject matter disclosed herein.

SBSROSSTK 300 comprises a turret base plate assembly 301, an adjustment hub assembly 302 and a turret knob assembly 303.

Turret base assembly 301 comprises a turret base 304, a plurality of screws 305 and a zero pin 306. Turret base 304 is fixedly attached in a well-known manner to, for example, a telescopic sight (not shown) or other optical enhancing device (not shown), such as by screws 305. A zero pin 306 is inserted into an aperture 307 in turret base 304.

Adjustment hub assembly 302 comprises an adjustment hub 309, internal ring gear 310, internal ring gear retainer 311, and a spade screw 312. The lower portion of adjustment hub 309 fits inside an aperture 308 that passes through turret base 304. The lower section of adjustment hub 309 threadably engages the upper portion of spade screw 312. Spade screw 312 passes through a slot in the body of the telescopic sight (not shown) and mechanically engages in a well-known manner an optical adjustor (not shown) of the telescopic sight. Hub assembly 302 is adjustably positionable in a well-known manner about an axis of rotation (not shown) in order to make adjustments to the scope (not shown).

Internal ring gear 310 fixedly fits around a larger diameter flange 313 of adjustment hub 309 and retains a spring-loaded tactile plunger 314 and a spring 315 within flange 313 of adjustment hub 309. Internal ring gear retainer 311 retains adjustment hub 309 and spring-loaded tactile plunger 314. Internal ring gear retainer 311 is held in place by screws 316 that extend through holes (not shown) in flange 317 of internal ring gear retainer 311 and internal-ring gear 310 to thread into turret base 304. Three spring-loaded stop plungers 318-1 through 318-3 and springs 319-1 through 319-3 are positioned in a slot 320 in internal ring gear retainer 311.

Turret knob assembly 303 comprises a turret knob 321, two knob locking set-screws 322 (of which only one is shown), six stop rings 323-1 through 323-6, six stop ring set screws 324-1 through 324-6, a retaining ring 325 to retain stop rings 323-1 through 323-6 within turret knob 321, a stop-ring clamp screw 326, and a stop pin 327. Turret knob assembly 303 is installed over the assembled adjustment hub assembly 302 and retained to the top groove of adjustment hub 309 with knob-locking set screws 322.

To "zero" the exemplary embodiment of the SBSROSSTK 300, the firearm is shot at the desired closest distance to the target with knob set screws 322 tightened. The knob assembly 303 is rotated so that the aiming point of the telescopic sight coincides with the projectile point of aim at the desired "zero" distance. Rotation of turret knob assembly 303 during the "zeroing" process rotates the adjustment hub assembly 302 to extend and/or retract the adjustment spade screw 312 which, in turn, adjusts the internal components of the optical sight (not shown). Knob set screws 322 are then loosened and knob assembly 303 is rotated clockwise (or counter clockwise) so that the base zero pin 306 and knob zero pin 327 "bump" one another at which point the "zero" numeral (not shown) etched on the outer circumference of knob assembly 303 aligns with the datum mark (not shown) of turret base assembly 301. Knob set-screws 322 are then tightened. Knob assembly 303 can then be returned to this "zero" setting at any time to assure the projectile impacts at the same desired point of impact at the same "zeroed" distance. It should be understood that the exemplary embodiment of SBOSSTK 300 could operate in either a clockwise or a counter-clockwise matter.

To set the "number one" (or first) stop position, stop-ring clamp screw 326 is loosened as are stop ring set screws 324-1 through 324-6. The firearm is shot at the distance desired for the first stop location. The knob assembly 303 is rotated counter-clockwise (or clockwise if the system is designed for the opposite direction) so that the "crosshair" reticle coincides with the desired projectile point of impact location at the distance for the first stop location. After the knob is rotated so that the reticle point of aim coincides with the projectile point of impact, protuberance 323-A (FIG. 3D) of stop ring 323-1 is engaged with spring-loaded stop plunger 318-1, and stop ring set screw 324-1 is tightened. Tightening of the stop ring set screw 324-1 prevents further rotation of stop ring 323-1, thereby creating the first rotational stop location.

The second selectable stop is set by rotating turret knob 321 to adjust the bullet impact with the point of aim on the target at the second desired distance. When the point of impact matches the point of aim at the second desired distance, protuberance 323-A of stop ring 323-2 is engaged with spring-loaded stop plunger 318-2, and the stop-ring set screw 324-2 for selectable-stop number 2 is tightened so that stop-ring number 323-2 does not rotate. This procedure is repeated for all six stop rings.

If fewer than six selectable stops are desired, the remaining stop rings are positioned at the full rotation position and their corresponding set screws are tightened. It should be understood that alternative exemplary embodiments can provide less than or greater than six stop-ring set screws for a corresponding number of selectable stops. At the completion of setting the selectable stops, stop-ring clamp screw 326 is tightened to ensure that the stop rings do not rotate during use.

For field operation, the distance to a target is first determined, then SBSROSSTK 300 is rotated to the (user set) stop corresponding to the target distance. When the stop is encountered there will be a definitive resistance to rotation (i.e., a relatively large tactile click) when the stop lobe of stop ring 323-1 interferes with spring-loaded stop plunger 316-1. If the target distance is slightly greater than or slightly less than the distance corresponding to the stop location, SBSROSSTK 300 can be appropriately rotated a few (relatively small) tactile clicks past or back from the stop lobe. Stop lobes can be over ridden by applying additional rotational force to turret knob assembly 303 to allow the stop lobe to depress stop plunger 316-1 against its corresponding plunger spring 318-1.

If SBSROSSTK 300 is used during darkness and viewing the numerical index values (not shown) on the outside circumference of the turret knob 321 is not possible or is difficult, SBSROSSTK 300 can be operated by tactile feel alone. In the situation in which an operator forgets the rotational position of the SBSROSSTK 300 or becomes otherwise confused, the SBSROSSTK 300 can be rotated in a clockwise direction to return to the "zero" position where fixed zero pin 306 and zero pin 326 stop rotation of SBSROSSTK 300. Once at the "zero" position, the operator can then start from the "zero" position and count selectable stops and clicks to achieve the desired rotational position of SBSROSSTK 300.

As SBSROSSTK 300 is rotated in the direction from the fully clockwise position towards the fully counter-clockwise position or in the direction of the fully counter-clockwise position to the fully clockwise position, each operator-selectable stop provides a stop position that can be overridden by applying additional rotational force to turret knob assembly 303. Between operator-selectable stops, SBSROSSTK 300 can be rotated for fine adjustments. To move beyond an operator-selected stop, additional rotational force must be applied to turret knob assembly 303.

Another exemplary embodiment of the subject matter disclosed herein permits a user to insert a multi-stop ring, which has pre-set mechanically stops for the adjustment knob to make a desired adjustment of an optical or power setting without the need to visually observe the value of the adjustment. Thus, optical or power settings made by a user are reliably made or repeated without the need for visual verification regardless of the environmental conditions.

Figure 4A:
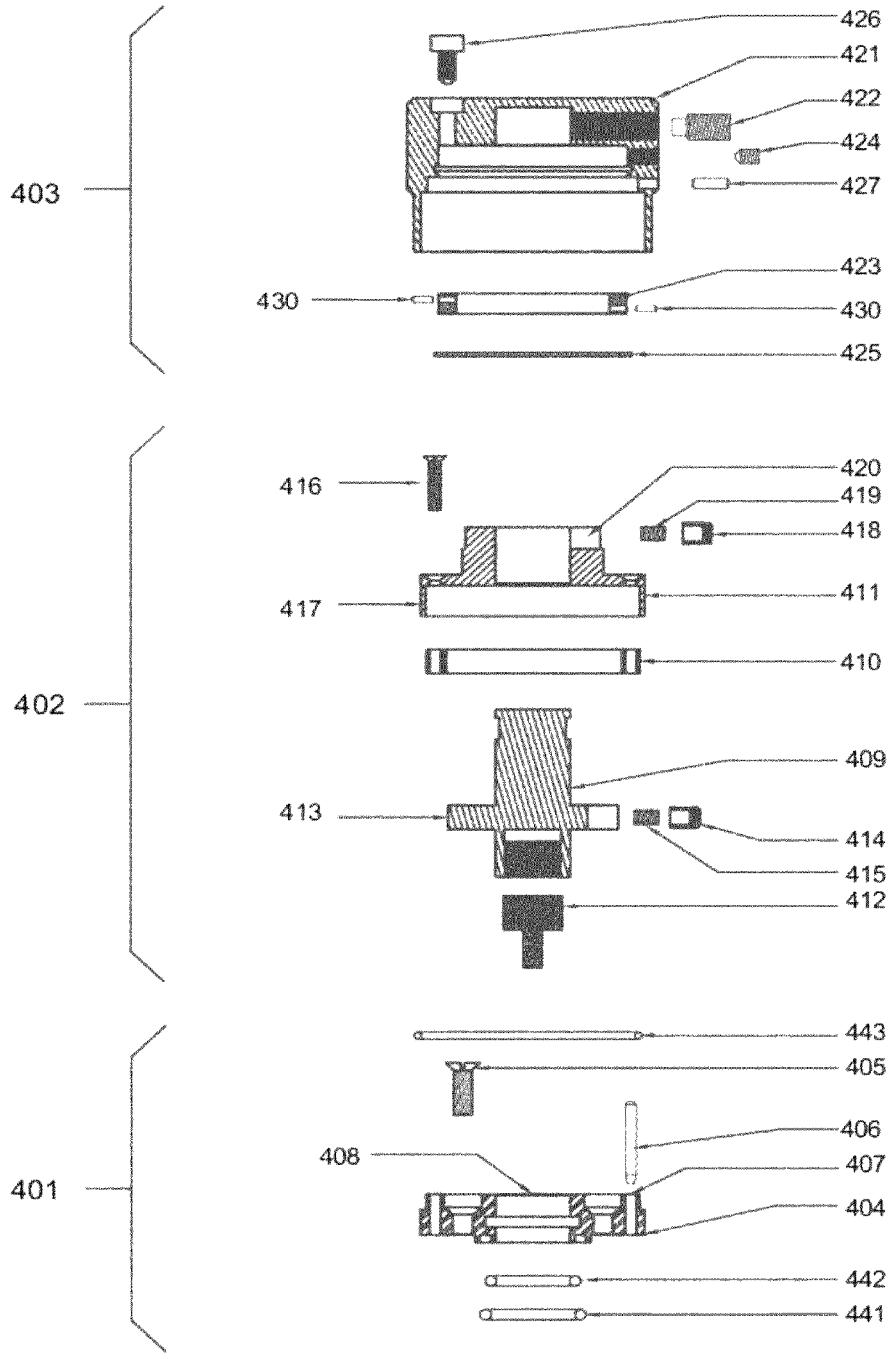
FIG. 4A depicts an exploded assembly cross-sectional view of an exemplary embodiment of a Pre-Set Stop Ring Turret Knob (PSSRTK) according to the subject matter disclosed herein.
Figure 4D:
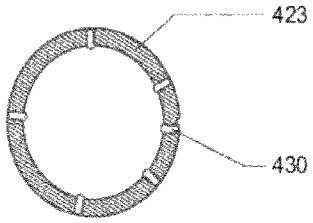
FIG. 4D shows a top cross-sectional view of an exemplary embodiment of a stop ring for the exemplary embodiment of the PSSRTK according to the subject matter disclosed herein.
Figure 4C:
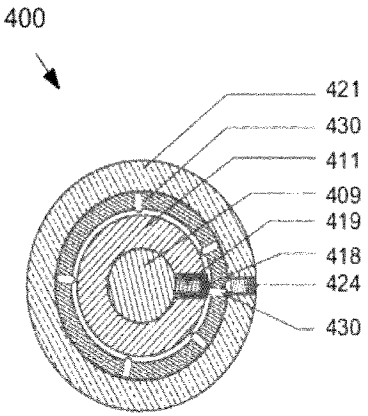
FIG. 4C shows a top cross-sectional view of the exemplary embodiment of the PSSRTK at a first stop configuration according to the subject matter disclosed herein.
Figure 4B:
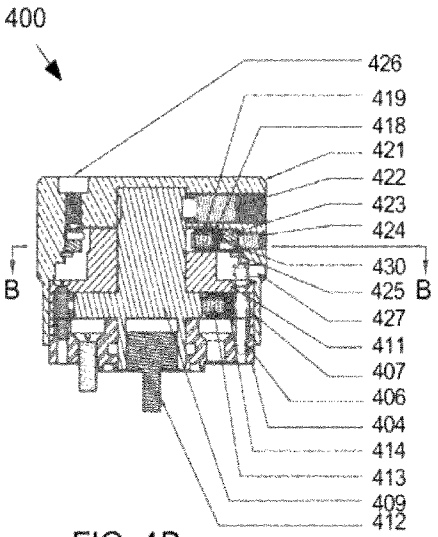
FIG. 4B depicts an assembled cross-sectional view of the exemplary embodiment of the PSSRTK in a "zeroed" configuration according to the subject matter disclosed herein.

FIG. 4A depicts an exploded assembly cross-sectional view of an exemplary embodiment of a Pre-Set Stop Ring Turret Knob (PSSRTK) 400 according to the subject matter disclosed herein. FIG. 4B depicts an assembled cross-sectional view of the exemplary embodiment of PSSRTK 400 in a "zeroed" configuration according to the subject matter disclosed herein. FIG. 4C shows a top view of the exemplary embodiment of SBPSTK 400 at the first stop configuration according to the subject matter disclosed herein. FIG. 4D shows a top view of an exemplary embodiment of a stop ring 423 for the exemplary embodiment of PSSRTK 400 according to the subject matter disclosed herein.

PSSRTK 400 comprises a turret knob base assembly 401, an adjustment hub assembly 402 and a turret knob assembly 403. Turret base assembly 401 comprise a turret base 404, a plurality of screws 405 and a zero pin 406. Turret base 404 is fixedly attached in a well-known manner to, for example, a telescopic sight (not shown) or other optical enhancing device (not shown), such as by screws 405. A zero pin 406 is inserted into an aperture 407 in turret base plate 404.

Adjustment hub assembly 402 comprises an adjustment hub 409, an internal-ring gear 410, an internal ring gear retainer 411, and a spade screw 412. The lower portion of adjustment hub 409 fits inside an aperture 408 that passes through turret base 404. The lower section of adjustment hub 409 threadably engages an upper portion of spade screw 412. Spade screw 412 passes through a slot in the body of the telescopic sight (not shown) and mechanically engages in a well-known manner an optical adjustor (not shown) of the telescopic sight. Hub assembly 402 is adjustably positionable in a well-known manner about an axis of rotation (not shown) in order to make adjustments to the scope (not shown).

Internal Ring Gear 410 fixedly fits around a larger diameter flange 413 of adjustment hub 409 and retains spring-loaded tactile plunger 414 and a spring 415 within flange 413 of adjustment hub 409. Internal ring gear retainer 411 retains adjustment hub 409, internal ring gear 410, and spring-loaded tactile plunger 414 and is held in place by screws 416 (of which only one screw 416 is shown) that extend through holes in a flange 417 of internal ring gear retainer 411 and internal-ring gear 410 to thread into turret base 404. A spring-loaded stop plunger 418 and a corresponding spring 419 are positioned in a slot 420 in internal ring gear retainer 411.

Turret knob assembly 403 comprises a turret knob 421, two knob-locking set screws 422 (of which only one is shown), a pre-set stop ring 423, a pre-set stop-ring set screw 424, a retaining ring 425 to retain pre-set stop ring 423 within the turret knob 421, a stop-ring clamp screw 426, and a stop pin 427. Turret knob assembly 403 is installed over the assembled adjustment hub assembly 402 and retained to the top groove of adjustment hub 409 with knob-locking set screws 422.

To "zero" the exemplary embodiment of PSSRTK 400, the firearm is shot at the desired closest distance to the target with knob set screws 422 tightened. The knob assembly 403 is rotated so that the aiming point of the telescopic sight coincides with the projectile point of aim at the desired "zero" distance. Rotation of turret knob assembly 403 during the "zeroing" process rotates the adjustment hub assembly 402 to extend and/or retract the adjustment spade screw 412 which, in turn, adjusts the internal components of the optical sight (not shown). Knob set screws 422 are then loosened and knob assembly 403 is rotated clockwise (or counter clockwise) so that the base zero pin 406 and knob zero pin 427 "bump" one another at which point the "zero" numeral (not shown) etched on the outer circumference of knob assembly 403 aligns with the datum mark (not shown) of turret base assembly 401. Knob set-screws 422 are then tightened. Knob assembly 403 can then be returned to this "zero" setting at any time to assure the projectile impacts at the same desired point of impact at the same "zeroed" distance. It should be understood that the exemplary embodiment of PSSRTK 400 could operate in either a clockwise or a counter-clockwise matter.

Stop pin 430 locations on pre-set stop ring 423 are determined by first "zeroing" the firearm. The firearm is then fired with the desired ammunition at the desired distances for any number of stop positions. When knob rotation is determined such that the bullet impact point matches the point of aim at the first desired distance, the index reading from the outside of turret knob 421 is recorded. To determine the location of the second stop pin location, the firearm is again fired with the same ammunition at the desired distance for the second stop position. When knob rotation is determined so that the bullet impact point matches the point of aim at the second desired distance, the index reading from the outside of turret knob 421 is recorded for that distance. The procedure is repeated for each distance for which pre-set stops are desired.

Pre-set stop ring 423 is then assembled with stop pins 430 inserted into holes corresponding to the rotational position of the turret knob 421 based off of a "zero" position. FIG. 4D shows a top view of an exemplary embodiment of a stop ring 423 for the exemplary embodiment of PSSRTK 400 in which stop pins 430 are depicted in selected exemplary locations. Once pre-set stop ring 423 is assembled, it is installed within turret knob assembly 403 by rotating turret knob 421 to a zero position and loosening knob-lock screws 422 and removing turret knob 421 from adjustment hub assembly 402. Pre-set stop ring 423 is then inserted into the bottom of turret knob 421 and is retained in place by retaining ring 425 and indexed to a "zero" position by stop-ring set screw 424. Without rotating adjustment hub assembly 402, turret knob assembly 403 is installed over adjustment hub assembly 402 and aligned to the "zero" position. Knob-lock screws 422 are then tightened to secure turret knob 421 to adjustment hub assembly 402.

PSSRTK 400 is operated by first determining the distance to the target and then rotating turret knob 421 to the selected stop corresponding to the target distance. When the stop is encountered, there will be a definitive resistance to rotation (i.e., a relatively large tactile click) when stop pin 430-1 of stop ring 423 interferes with spring-loaded stop plunger 418. If the target distance is slightly greater than or slightly less than the distance corresponding with the stop location, the knob can be appropriately rotated a few tactile clicks past or back from stop pin 430-1. Stop pins 430 can be over ridden by applying additional rotational force to turret knob 421 to allow stop pin 427 to depress the stop plunger 418 against its corresponding plunger spring 419.

As PSSRTK 400 is rotated in the direction from the fully clockwise position towards the fully counter-clockwise position or in the direction of the fully counter-clockwise position to the fully clockwise position, each operator-selectable stop provides a stop position that can be overridden by applying additional rotational force to turret knob 421. Between operator-selectable stops, PSSRTK 400 can be rotated for fine adjustments. To move beyond an operator-selectable stop, additional rotational force must be applied to turret knob 421.

If PSSRTK 400 is used during darkness and viewing the numerical index values on the outside circumference of turret knob 421 is not possible or is difficult, PSSRTK 400 can be operated by tactile feel alone. If the rotational position of PSSRTK 400 is forgotten or the operator becomes otherwise confused, PSSRTK 400 can be rotated in a counter-clockwise direction to return to the "zero" position where zero pins 406 and 427 stop rotation of the knob. The operator can then start from a beginning "zero" position and count stops and clicks to achieve the desired knob rotational position.

Although the foregoing disclosed subject matter has been described in some detail for purposes of clarity of understanding, it will be apparent that certain changes and modifications may be practiced that are within the scope of the appended claims. Accordingly, the present embodiments are to be considered as illustrative and not restrictive, and the subject matter disclosed herein is not to be limited to the details given herein, but may be modified within the scope and equivalents of the appended claims.

What is claimed is:

1. A turret knob, comprising an adjustable member capable of being adjustably positionable about an axis of rotation;

an engagement member coupled to the adjustment member, a relative position of the engagement member with respect to the axis of rotation corresponding to a position of the adjustable member as the adjustable member is adjustably positioned about the axis of rotation; and a plurality of stop members positioned about the axis of rotation, each stop member capable of interfering with the engagement member and blocking movement of the adjustable member as the adjustable member is adjustably positioned about the axis of rotation, and the adjustable member being adjustably positionable about the axis of rotation between adjacent stop member positions.

2. The turret knob according to claim 1, wherein the engagement member is releasable from a stop member when the stop member interferes with the engagement member and blocks the adjustable member so that the adjustable member is adjustably positionable past the stop member.

3. The turret knob according to claim 2, wherein at least one stop member is selectably positionable by a user.

4. The turret knob according to claim 3, further comprising a release member coupled to the engagement member, the release member capable of being actuated to release the engagement member from a stop member when the stop member interferes with the engagement member and blocks the adjustable member so that the adjustable member is adjustably positionable past the stop member.

5. The turret knob according to claim 4, wherein the engagement member comprises a stop pin coupled to the release member, and wherein the plurality of stop members comprise a ball bearing, or a stop pin, or combinations thereof.

6. The turret knob according to claim 5, wherein the release member is pressed to be actuated.

7. The turret knob according to claim 4, wherein the release member is lifted to be actuated.

8. The turret knob according to claim 3, wherein the engagement member is releasable from a stop member by increasing a force applied to the adjustable member to adjustably position the adjustable member about the axis of rotation.

9. The turret knob according to claim 8, wherein the engagement member comprises a protuberance on a stop ring, and wherein the stop ring is a spring-loaded stop plunger.

10. The turret knob according to claim 3, wherein the adjustable member is coupled to an adjuster of an optical enhancement device, the adjuster having an adjustment setting, and a change in the selected position of the adjustment member produces a change in the adjustment setting of the adjuster of the optical enhancement device.

11. The turret knob according to claim 10, wherein the optical enhancement device comprises a telescopic sight, a telescope or microscope.

12. The turret knob according to claim 1, wherein the adjustable member is coupled to an adjuster of an optical enhancement device, the adjuster having an adjustment setting, and a change in the selected position of the adjustment member produces a change in the adjustment setting of the adjuster of the optical enhancement device.

13. The turret knob according to claim 12, wherein the optical enhancement device comprises a telescopic sight, a telescope or a microscope.

* * * * *